US005797559A

United States Patent [19]

Coffey

[11] Patent Number: 5,797,559

[45] Date of Patent: *Aug. 25, 1998

[54] WINDING ARBOR HAVING A PLURALITY OF AIR VALVES FOR MAKING CORELESS PAPER ROLLS AND METHOD FOR USING

[75] Inventor: James B. Coffey, Vandalia, Ohio

[73] Assignee: NCR Corporation, Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 715,512

[22] Filed: Sep. 18, 1996

[51] Int. Cl.[6] ..... B65H 35/04

[52] U.S. Cl. ..... 242/527.6; 242/532.2; 242/542; 242/581

[58] Field of Search ..... 242/527.5, 527.6, 242/532.2, 542, 581

[56] References Cited

U.S. PATENT DOCUMENTS

| | | | |
|---|---|---|---|
| 2,378,024 | 6/1945 | MacChesney | 242/581 |
| 2,385,692 | 9/1945 | Corbin et al. . | |
| 2,575,631 | 11/1951 | Link . | |
| 2,694,848 | 11/1954 | Chaya | 242/527.5 X |
| 3,599,889 | 8/1971 | Pfeiffer | 242/542 X |
| 3,802,639 | 4/1974 | Dowd, Jr. . | |
| 3,856,226 | 12/1974 | Dowd, Jr. . | |
| 3,892,012 | 7/1975 | Keferstein | 242/532.2 X |
| 3,908,924 | 9/1975 | Schulze | 242/532.2 X |
| 3,942,735 | 3/1976 | Marchio et al. | 242/581 X |
| 3,995,747 | 12/1976 | Lewey et al. . | |
| 4,133,495 | 1/1979 | Dowd | 242/532.2 |
| 4,220,291 | 9/1980 | Papa | 242/571.1 X |
| 4,327,877 | 5/1982 | Perini . | |
| 4,408,727 | 10/1983 | Dropczynski . | |
| 4,473,195 | 9/1984 | Marin | 242/571.1 |
| 4,487,377 | 12/1984 | Perini . | |
| 4,572,451 | 2/1986 | Ikeda et al. . | |
| 4,611,638 | 9/1986 | Matumura . | |
| 5,452,496 | 9/1995 | Long et al. . | |
| 5,453,070 | 9/1995 | Moody . | |

FOREIGN PATENT DOCUMENTS

| | | | |
|---|---|---|---|
| 2244190 | 3/1974 | Germany . | |
| 3239661 | 5/1984 | Germany . | |
| 6037943 | 4/1981 | Japan | 242/532.2 |
| 6136745 | 10/1981 | Japan | 242/532.2 |
| 623155 | 5/1949 | United Kingdom | 242/581 |

*Primary Examiner*—Donald P. Walsh
*Assistant Examiner*—William A. Rivera
*Attorney, Agent, or Firm*—Charlene Stukenborg

[57] ABSTRACT

An apparatus and method for making coreless paper rolls includes a slitting machine having a winding arbor having a plurality of two-way air valves spaced over the tube wall of the winding arbor and being connected to a control valve for supplying compressed air or vacuum to the arbor, and a cutter design is provided.

19 Claims, 10 Drawing Sheets

FIG. 4
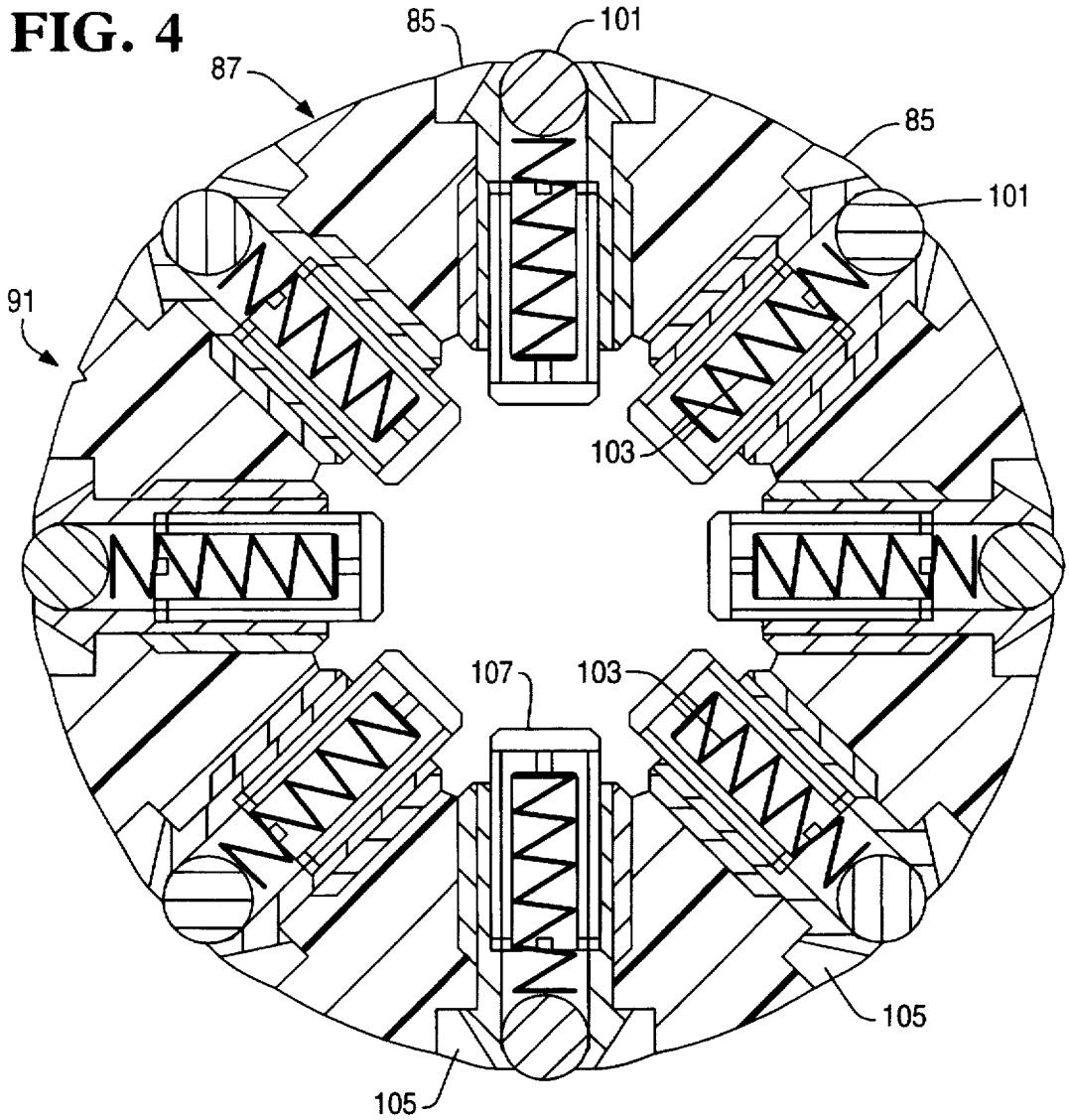
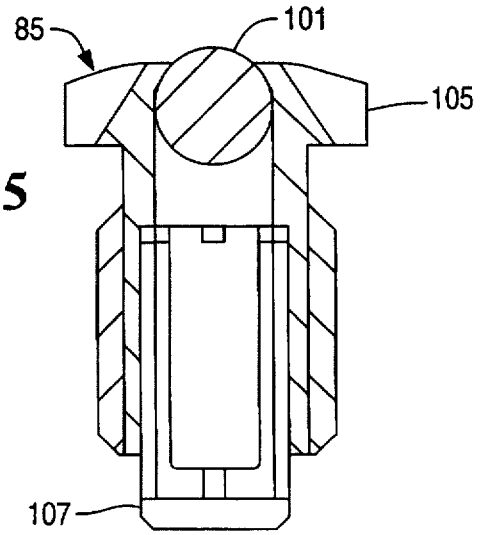
FIG. 5

WINDING ARBOR HAVING A PLURALITY OF AIR VALVES FOR MAKING CORELESS PAPER ROLLS AND METHOD FOR USING

BACKGROUND OF THE INVENTION

The present invention relates to an apparatus and method for providing coreless paper rolls. In particular, the coreless paper rolls are also tuckless at the interior edge.

Paper rolls generally are produced using separate core material of plastic or paper fiber for the internal cores and are wound on arbors (also known as mandrels or spindles) that fit loosely inside the auxiliary cores. These paper rolls formed on cores are tucked and/or glued at the outer diameter of the auxiliary cores and include a tuck at the interior edge. Paper rolls formed on cores are not compatible with automated teller machine (ATM) printers or many other devices that load paper rolls automatically.

Current designs to produce coreless paper rolls, such as for coreless fax paper, have been wound on solid arbors or arbors that have incorporated air pressure for removal of the finished wound rolls and have tucks to start the winding. Arbors incorporating air pressure have holes in the arbor to provide either vacuum pressure (for starting winding) or compressed air pressure (for removing coreless rolls). A three-way air valve may be used to control the direction of air flow to the arbor. When a manufacturer attempts to produce tightly wound coreless rolls (necessary for high-quality rolls) using a solid shaft, the rolls are very difficult to remove from the shaft without telescoping or otherwise damaging the finished rolls. If a manufacturer uses an arbor with a plurality of holes for use with compressed air or a vacuum without using air valves to control the passage of air, then very high volumes of compressed air and a very large vacuum pump system are required.

Currently tuckless coreless rolls are formed with a tuck and then the tuck is pulled out in a telescoping fashion, cut off, and the remainder returned to the interior of the roll. However, it is difficult to achieve a precise, straight edge using this process since the tuck to be removed is attached to the paper in the roll. Also, if the coreless roll is wound too tightly it is difficult to get the tuck outside the roll so the tuck can be removed.

Coreless paper rolls for devices that automatically load paper must be able to be shipped and arrive with the concentricity/circularity requirements within specifications in order to avoid jamming the devices. There is a need for an apparatus and method for providing tuckless, coreless paper rolls which conform to these requirements.

SUMMARY OF THE INVENTION

In accordance with the teachings of the present invention, an apparatus including a slitting machine having a winding arbor having a plurality of special two-way air valves spaced over the tube wall of the winding arbor and being connected to a control valve for supplying compressed air or vacuum to the arbor, and a unique cutter design or a unique tucker blade design is provided.

It is an important feature of the present invention that the inner edges of the coreless rolls produced by the apparatus and method are tuckless and have machine cut substantially straight edges to permit auto loading of the coreless rolls.

It is also an important feature of the present invention that the apparatus and method produce coreless rolls that are rolled very tight to prevent telescoping and to avoid damage due to crushing during shipment.

It is accordingly an object of the present invention to provide an apparatus and method of producing very tightly wound coreless paper rolls which do not have interlocking problems related to paper rolls which have a tuck at the inner edge of the roll.

It is another object of the present invention to provide an apparatus and method of producing tuckless, coreless paper rolls having relatively small diameters.

It is another object of the present invention to provide an efficient and convenient means for slitting and surface winding coreless paper rolls used with ATM machines that automatically load paper rolls.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

FIG. 4 is a cross-sectional view of the first design of the winding arbor;

FIG. 5 is a detailed view of an air valve assembly for use in the present invention;

DETAILED DESCRIPTION OF THE PREFERRED EMBODIMENT

Figure 1:
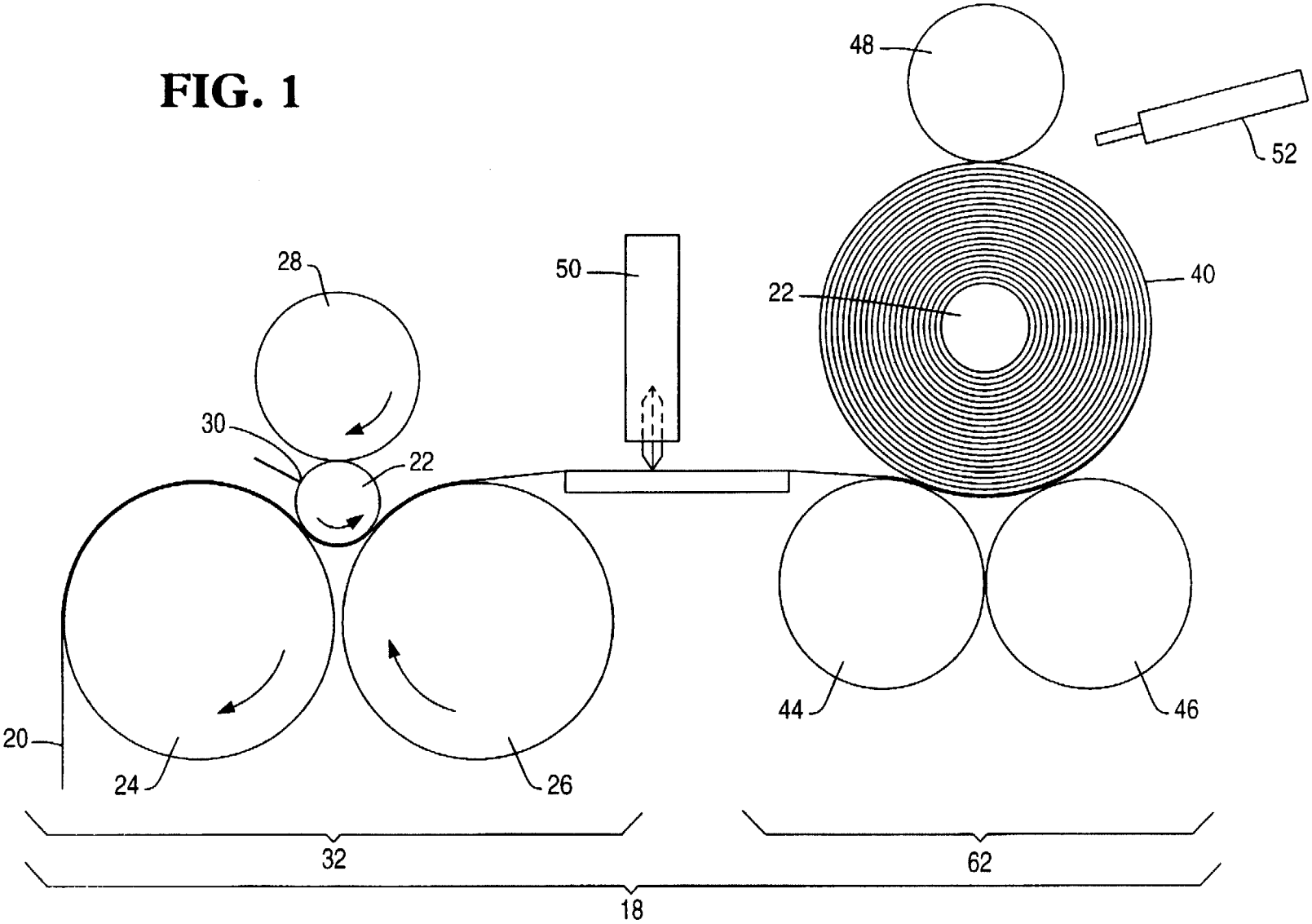
FIG. 1 is a diagram of a winding and slitting apparatus used in accordance with a first embodiment of the present invention.

Referring now to the drawings, in which like-referenced characters indicate corresponding elements throughout the several views, attention is first drawn to FIG. 1 which shows a diagram of a slitting and winding apparatus for producing tuckless, coreless paper rolls according to a first embodiment of the present invention. Any basic slitting and winding machine such as Jennerjahn slitters sold by Jennerjahn of Matthews, Ind. may be used in conjunction with the present invention.

Figure 3:
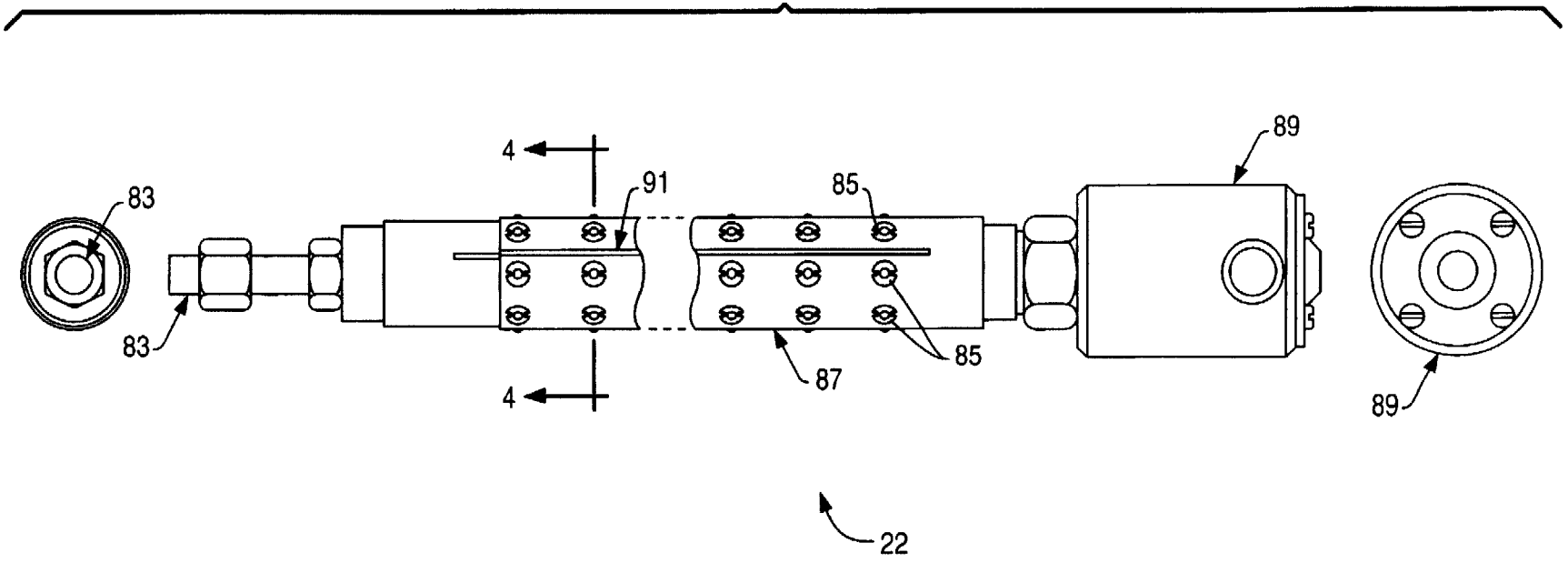
FIG. 3 is a view of a first design of a winding arbor for use in the first embodiment of the present invention.

Apparatus 18 includes a winding station 32 and a sealing station 62. Winding station 32 includes a winding arbor 22 having a cutting groove 91 (FIG. 3). Winding arbor 22 is supported by two bed rolls 24 and 26 and a rider roll 28 tracks the winding arbor 22 from above. Standard arbor guides (not shown) limit transversal movement of the winding arbor 22. Winding station 32 also includes a manual tail cutter 30.

Sealing station 62 includes sealer bed rolls 44 and 46 and sealing rider roll 48. Sealing station 62 also includes auto tail cutter and glue station 50 and auto tabber 52.

Figure 2:
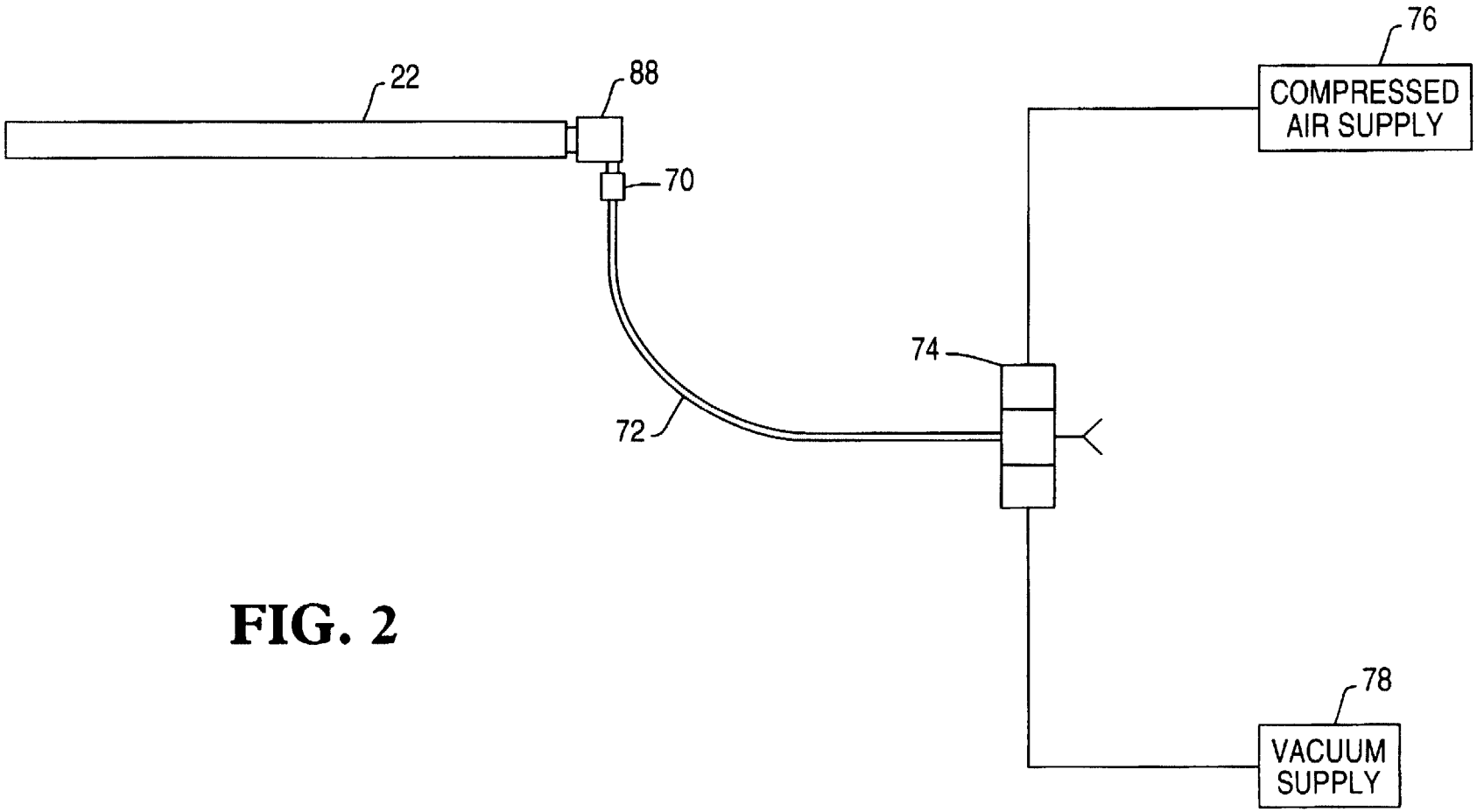
FIG. 2 is a diagram of control supplies for the apparatus of FIG. 1.

Referring to FIG. 2, a diagram of the valve, hoses and supplies connected to the winding arbor 22 of the present invention are shown. Quick-disconnect 70 attaches one end of flexible hose 72 to a rotary union 88 and the winding arbor 22. Flexible hose 72 is preferably ½" diameter standard air hose. The other end of flexible hose 72 is connected to a 3-position manually operated air valve 74. The air valve 74 is connected to a compressed air supply 76 which is normally available throughout a manufacturing factory and generally has a pressure of about 85 psi. If preferred, a compressed air tank having a pressure of about 125 and 150 psi could be provided. The air valve 74 is also connected to a vacuum tank supply 78. Any sources for providing the required compressed air and vacuum can be used. Vacuum tank supply 78 preferably has at least a 12 gallon capacity.

FIG. 3 shows a first design of a winding arbor 22 for use in the first embodiment of the present invention. Winding arbor 22 is formed of a tube 87 having a series of special two-way air valves assemblies 85 which are spaced throughout the tube wall of the tube 87. Preferably tube 87 is a stainless steel tube, but can be any type of tubing material such as nylon or aluminum. Preferably eight air valve assemblies 85 having a #10-32 tap thru and a counterbore are provided equally spaced in a row extending around the winding arbor 22. Preferably the eight air valve assemblies 85 are provided in each row and align with the valve assemblies in the previous row. The air valve assemblies 85 must extend between the outer surface and the inner surface of the tube 87. Preferably over five hundred air valve assemblies are spaced over the winding arbor 22. Of course the number of air valve assemblies depends on many system requirements such as the type of paper, the width of the paper, gaps between roll, etc. Winding arbor 22 has a threaded plug 83 at one end which rides against an arbor guide of the slitting machine. The other end of winding arbor 22 includes a rotary union 89 with a side quick disconnect to connect with the flexible hose as shown in FIG. 2. Rotary union 89 also rides against an arbor guide of the slitting machine. Preferably, rotary union 89 has the largest internal diameter possible to allow maximum air flow. Winding arbor 22 has a cutting slot 91, preferably having a "v" shape with a 30 degree angle and 1/16 inch depth. This cutting slot 91 accommodates the cutter (FIGS. 1 and 6) for manually cutting a pretuck tail.

FIGS. 4 and 5 show the special two-way air valve assemblies 85 in more detail. FIG. 4 shows a cross-section of typical specially designed air valve assemblies 85 each incorporating a chrome steel ball 101, a compression spring 103, a valve seat 105, and a ball restricter insert 107. Chrome steel ball 101 preferably has a diameter of 0.0937 inches. Compression spring 103 is preferably formed of 0.007 diameter music wire. The required spring rate is preferably 1.8–2.0 lbs./in. The spring preferably has a free length of 0.25 inches and an initial compressed length of approximately 0.215 inches. The top of the valve seat 105 into which the ball nests when the valve is closed has an angled design and is preferably made of brass. The angled design must fit within the counterbores so the overall surface of the winding arbor with the air valve assemblies installed is substantially smooth (with the balls in the open position). The remainder of the valve seat 105 is preferably stainless steel or brass. Ball restricter insert 107 has a central orifice and four orifices located along the circumference to provide air flow around the ball 101 if it is seated on the ball restricter insert 107. Ball restricter insert 107 also prevents the ball and spring from being pulled into the center of the tube 87.

FIG. 5 shows a cross-section of the valve seat 105, ball restricter insert 107 and ball 101 without compression spring 103. Depending on the desired characteristics, compression spring 103 may or may not be needed to force the valves into a closed position when desired.

Figure 6:
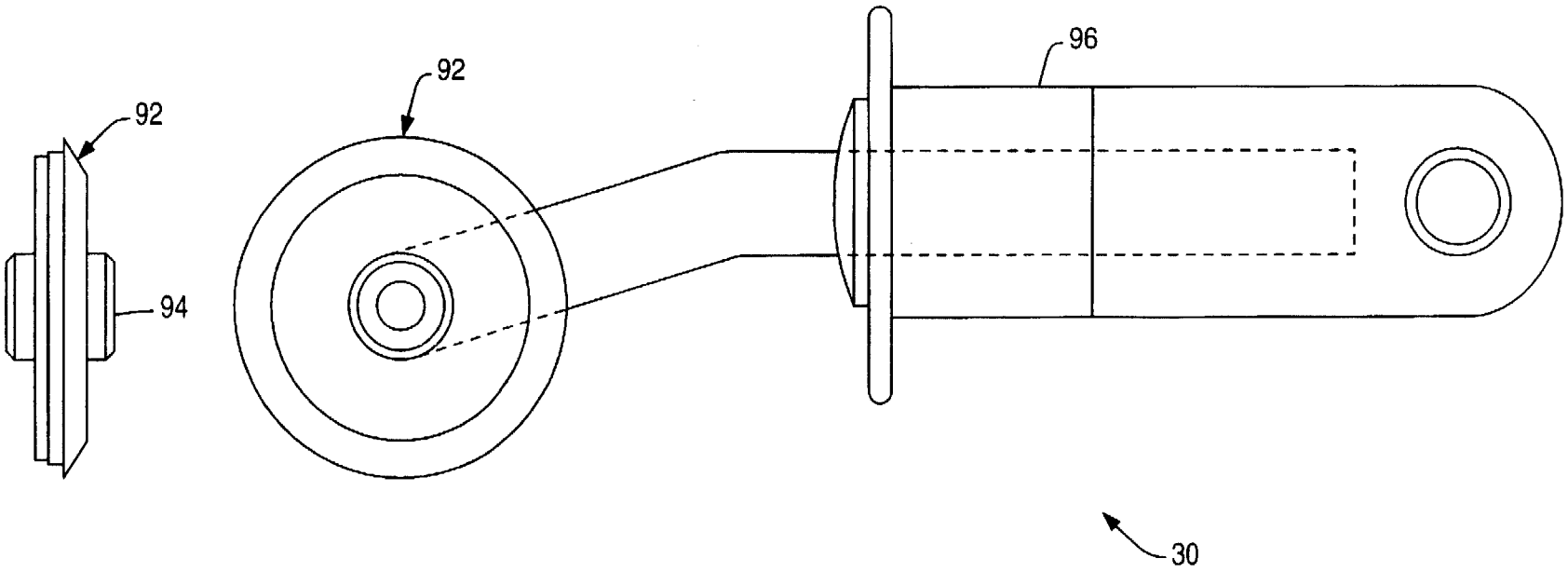
FIG. 6 shows the cutter for use with the first embodiment of the present invention.

Referring to FIG. 6, tail cutter assembly 30 includes a circular angled blade 92 which is attached by a stud 94 to an angled handle 96. Angled handle 96 requires a fairly low profile in order to fit in the tight space in a standard slitter machine before winding on the winding arbor begins.

In operation, to begin the winding process, a web 20 is provided for being wound into rolls on the winding arbor 22. Web 20 may be any standard paper stock and may have various width dimensions. A small tail is automatically pretucked in the leading edge of web 20. Manually operated, 3-position air valve 74 is set to connect winding arbor 22 and vacuum supply 78. This provides a vacuum through air valve assemblies 85 in winding arbor 22 to secure the leading edge of web 20 to winding arbor 22. Manual cutter 30 then cuts the pretucked tail at the cutting groove 91. The cutting groove 91 insures that the edge will be substantially straight. The cut pretucked tail is removed before the winding is begun. As winding begins, the vacuum is provided through air valves assemblies 85 as the first winding of paper is formed. Thus, the vacuum holds the paper to the winding arbor 22 before and after the cutter cuts the pretucked tail. As paper from web 20 is wrapped around the arbor 22, the steel ball in each air valve is depressed. Thus a vacuum is pulled through the air valve assemblies 85 in the arbor 22 to secure the paper to the arbor 22. After the first winding is completed, the vacuum can be removed. The bed rolls 24 and 26, rider roll 28 and winding arbor 22 continue to turn and winding continues as normal until complete rolls are achieved.

After winding is completed, the rolls are moved to the sealing station 62. To prepare for removal of the rolls, the 3-position manually operated air valve connects the winding arbor 22 to the compressed air supply 76. Air pressure is applied through the air valve assemblies 85 in the winding arbor 22 to remove the tightly wound rolls without causing telescoping. As the paper roll is covering the balls, the air valve assemblies 85 are open. When the compressed air supply 76 is connected to the system, compressed air applies pressure to the inner diameter of the rolls. This pressure provides a thin cushion of air between the wound rolls and the tube of the arbor 22 by forcing the paper rolls that have been tightly wound on the arbor to expand. When the core of the roll expands, this fills the space between the outside surface of the winding arbor and the inner diameter of the roll. This thin cushion of air has an air bearing effect permitting the easy removal of the rolls from the winding arbor for coreless rolls. Once the paper rolls are no longer covering individual air valves, the compression spring and/or the compressed air push the ball against the valve seat, closing the valve.

Figure 7:
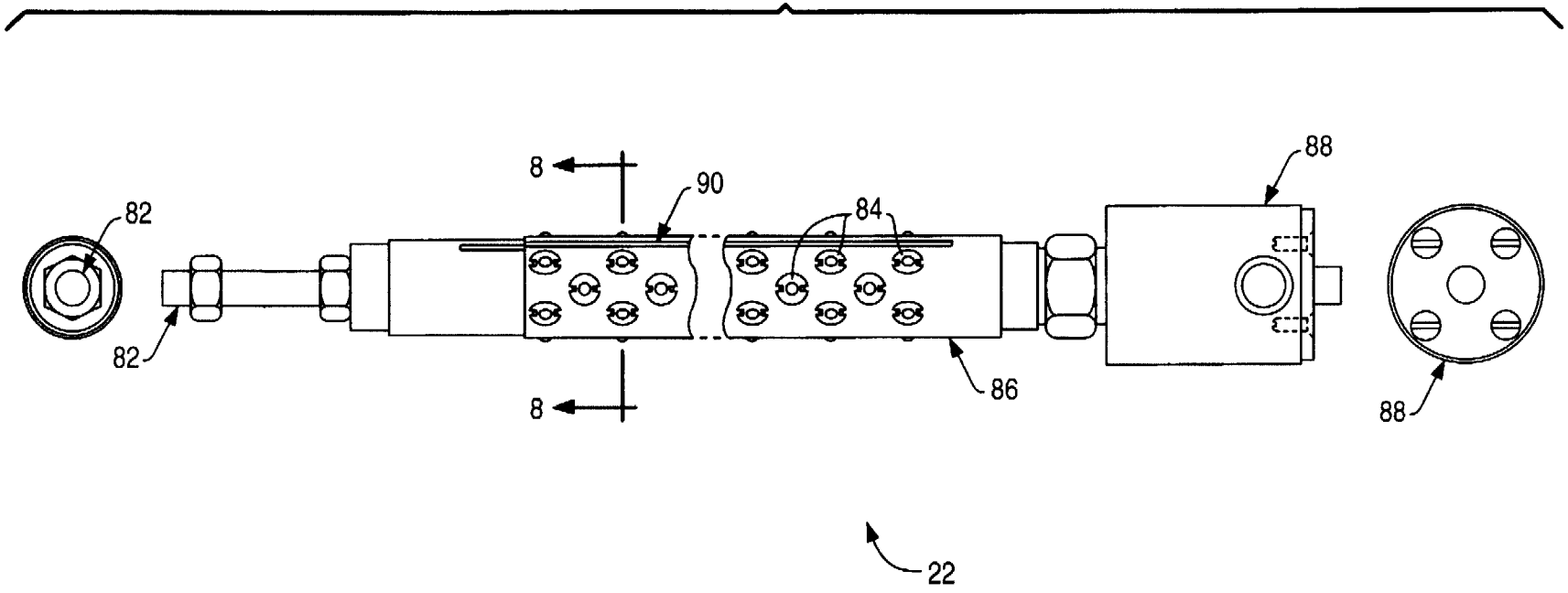
FIG. 7 is a view of a second design of a winding arbor for use in the first embodiment of the present invention.
Figure 8:
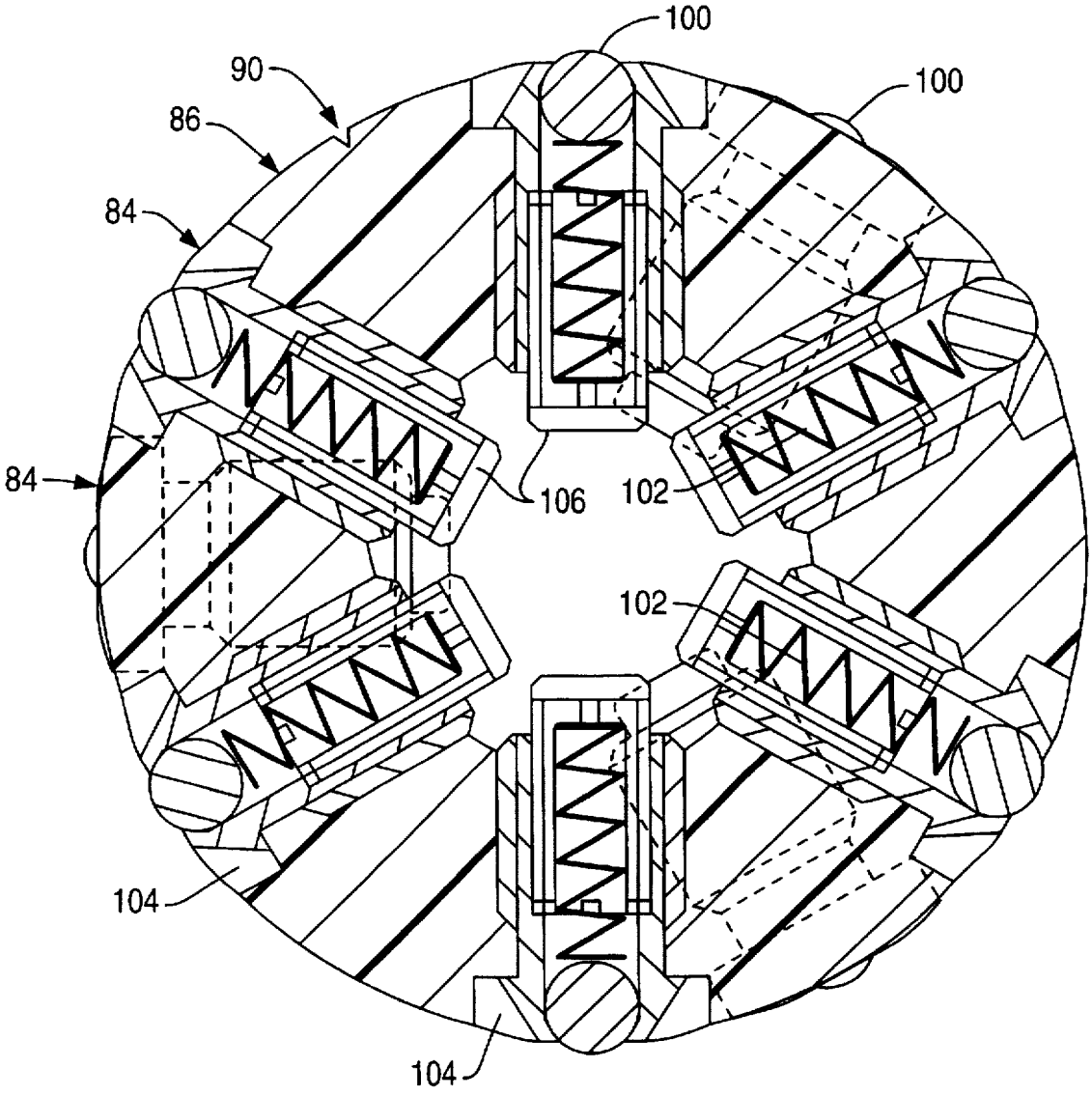
FIG. 8 is a cross-sectional view of the second design of the winding arbor.

FIGS. 7 and 8 show a second design of a winding arbor. This design is the same as that shown in FIGS. 3–5 and described above except the special two-way air valve assemblies 84 are offset. Preferably six air valve assemblies 84 are provided in each row and neighboring rows of air valves assemblies 84 are offset to increase the overall amount of pressure or vacuum provided through winding arbor 22. This design provides more valve surface area enabling the vacuum to hold thinner rolls or the compressed air to push off thinner rolls on the winding arbor.

An advantage of this first embodiment is that because the arbor includes a plurality of two-way air valve assemblies, the compressed air supply and vacuum supply are conserved. As the paper roll is removed from the winding arbor, the air valve assemblies which are no longer effective (as the roll has been removed from that particular area) are closed. In the start up operation, the vacuum is only applied for the first round.

Figure 9:
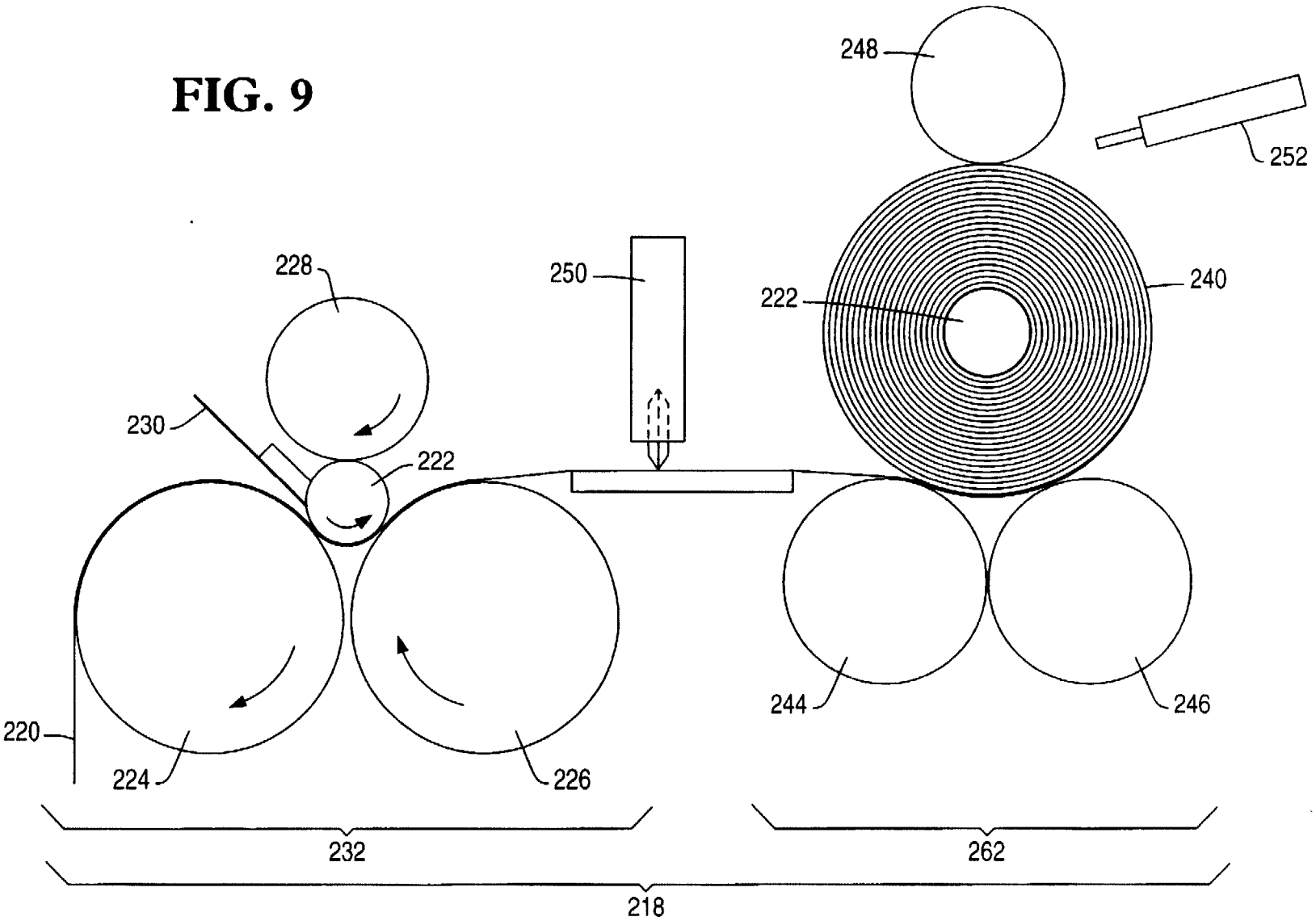
FIG. 9 is a diagram of a winding and slitting apparatus used in accordance with a second embodiment of the present invention.
Figure 10:
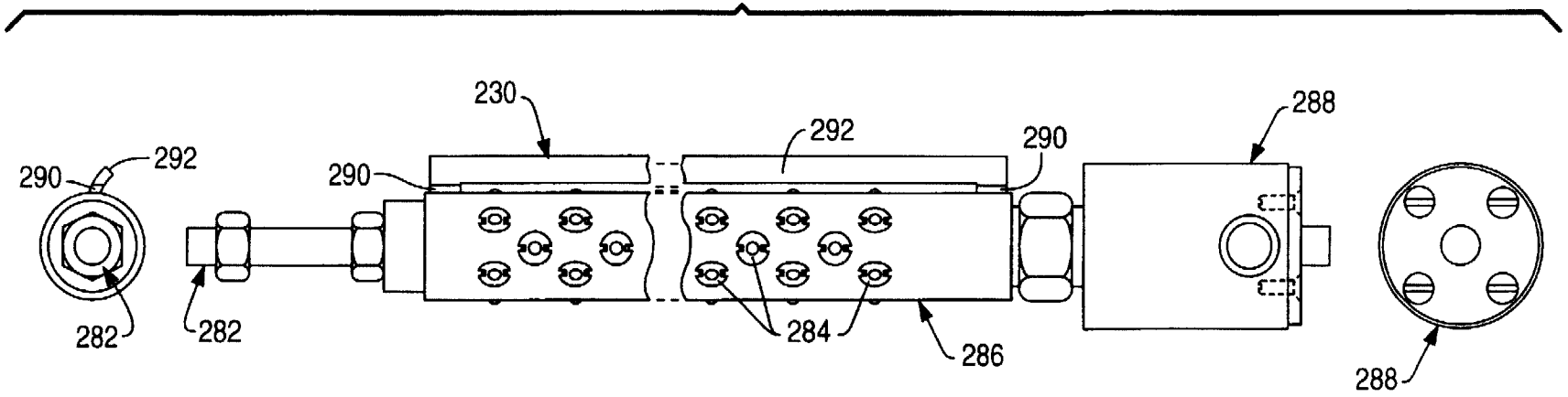
FIG. 10 is a view of a winding arbor and tucker blade for use in the second embodiment of the present invention.

A second embodiment of an apparatus and method for producing coreless, tuckless rolls with a substantially straight cut at the inside edge of the coreless roll is shown in FIGS. 9 and 10. As described in the previous embodiment, a standard slitting and winding machine may be used. However with this embodiment, the machine must include a back-up feature. Machines sold by Jennerjahn can be specified to include this feature. This embodiment also uses the special two-way air valve assemblies that incorporate a steel ball, compression spring and valve seat as described in detail in the description of the first embodiment.

Apparatus 218 includes a winding station 232 and a sealing station 262. Winding station 232 includes a winding arbor 222. Winding arbor 222 is supported by two bed rolls 224 and 226. A rider roll 228 tracks the winding arbor 222 from above. Winding station 232 also includes a specially designed curved tucker blade 230, or curved guide blade, as described below.

Sealing station 262 includes sealer bed rolls 244 and 246 and sealing rider roll 248. Sealing station 262 also includes auto tail cutter and glue station 250 and auto tabber 252.

Referring to FIG. 10, a view of the winding arbor 286 and the tucker blade 230 is shown. Winding arbor 286 has a plurality of two-way air valve assemblies 284 as described with the previous embodiment. Rotary union 288 and threaded plug 282 fit on each end of winding arbor 286 similar to that described in the description of the first embodiment. Tucker blade 230 is adjacent to winding arbor 286 and is preferably made of a tempered spring steel blade 292 and has HMW plastic or any other bearing-like plastic attached at both ends 290. The tucker blade 230 has a curved blade 292 preferably having a radius of approximately 0.5150 inches. The bearing-like plastic ends 290 each have a radius of approximately 0.5 inches providing a slight clearance under the blade for the initial paper roll(s).

To begin the winding process, a web 220 is provided to the winding station 232. Except for the first roll produced in the process, the beginning of the winding of a new paper roll begins simultaneously with the cutting of the end of the previously wound roll. The auto tail cutter 250 makes a substantially straight cut on the outside tail of the finished roll and simultaneously produces a substantially straight cut on the inside tail of a new roll. The winding arbor 222 is positioned over top of the paper web 220 and between the bed rolls 224 and 226 at the winding station 232. The rider roll 228 is raised away from winding arbor 222. An air blast, available from a blow-over feature on Jennerjahn slitters, blows the auto cut inside tail over the top side of the winding arbor 222. The rider roll 228 at the winding station 232 is then lowered, holding the blown-over tail tight against the winding arbor 222. The back-up feature is used to back up the winding station 232 to a specified inside tail length that eliminates a tail tuck. This back-up feature was developed to enable a user to produce rolls with a desired tail length. However, it is not believed to have been used for producing entirely tuckless rolls. In order to produce tuckless rolls, the unique tucker blade 230 described below is needed to guide the tuckless end.

The curved guiding surface of the special designed tucker blade 230 is then placed in close proximity with the winding arbor 222. While in this position, a vacuum is applied to the arbor 222 through the special two-way air valve assemblies 284 and the winding operation is started. As the bed rolls 224 and 226, winding arbor 222 and the rider roll 228 start turning, this turning drives the inside tail between the winding arbor 222 and the curved guiding surface of the tucker blade 230. After approximately one turn, the vacuum can be released and the tucker blade 230 retracted to its home position away from the paper roll being wound. The tucker blade 230 includes specially designed bearing features for contacting the winding arbor 222 and a thin space between the winding arbor 222 in the area where the paper is being wound. These features insure that the tucker blade 230 can allow the winding arbor to continue winding paper while the tucker blade is retracting so there is no interference with the winding operation. The coreless roll is then wound to the proper diameter and the slitting machine stops winding.

The finished rolls with winding arbor 222 inside are moved to the sealing station 262. The air hose is then disconnected from the arbor 222 located inside the finished rolls. A new winding arbor 222 is positioned at the winding station 232 and the air hose is connected to the just placed winding arbor 222. The next cycle begins and the finished rolls are glued or tabbed at the sealing station 262 and then ejected from the machine. The finished rolls are removed from the winding 222 arbor by connecting a compressed air supply to the quick-disconnect fitting and then removing the rolls from the arbor 222 using the special air valve assemblies 284 as described in the description of the first embodiment.

Alternately, after the finished rolls have been moved to the sealing station 262, a new winding arbor 222 can be placed in position at the winding station 232 and then the inner and outer tails can be manually cut. Then the arbor loaded with rolls can be manually removed from the front side of the machine. Then air pressure can be applied to the arbor just removed and connected to the newly loaded winding arbor. Then a new cycle begins.

Figure 11:
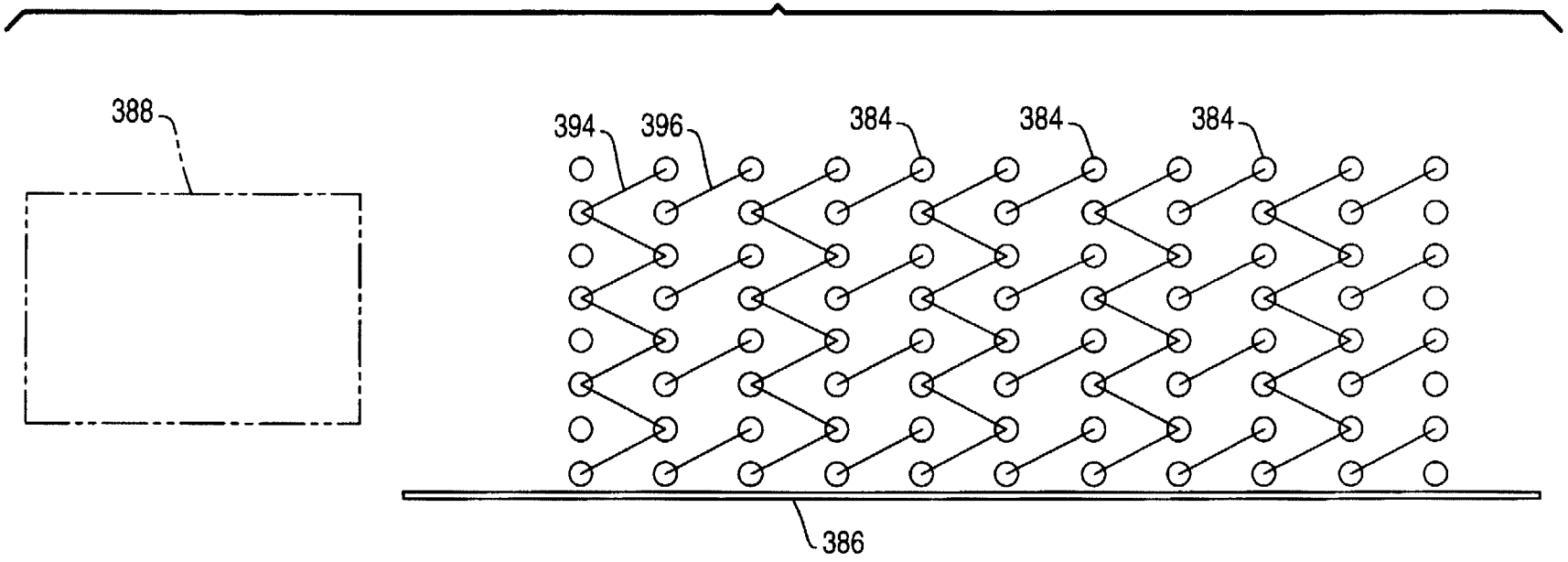
FIG. 11 shows a winding arbor having grooves to help air flow according to the present invention.

FIG. 11 provides a drawing of an additional feature which can be incorporated in the winding arbors described above. The winding arbor 386 includes a plurality of air valve assemblies 384. Connecting at least two of these air valve assemblies in a diagonal pattern with a shallow groove, preferably about 0.2 inches deep, provides additional pressure on the inside of the coreless roll during the removal operation. A variety of groove patterns or no grooves at all can be used depending on the desired results and the requirements of the product being wound. For example, winding arbors for winding very thin rolls may not be able to hold a vacuum if grooves are used.

Figure 12:
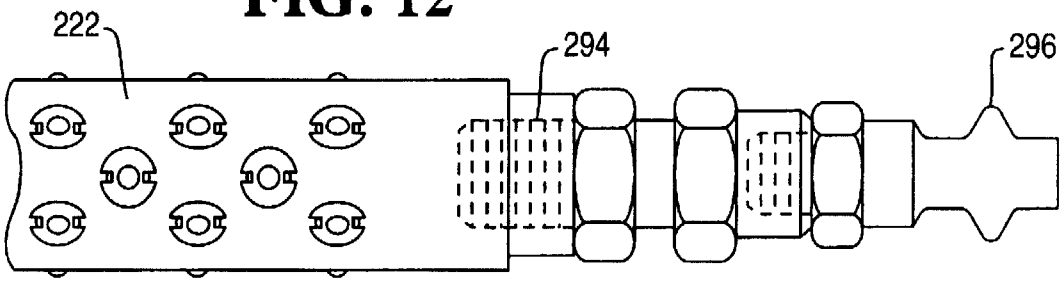
FIG. 12 shows a second design for connection of the winding arbor to the air supply control valve.

Although the description above includes both a vacuum supply and a compressed air supply, it should be recognized that some methods may only require a compressed air supply. In such methods, the quick disconnect may be used to connect the winding arbor 222 and the compressed air supply. An example of a second connection design is shown in FIG. 12. In this method, the rotary union on the end of the winding arbor is replaced with a quick-disconnect adapter 294 and nipple 296. This method may be desired depending on the type of substrate being used for the product being produced. Highly porous materials may not be held by the vacuum process.

An advantage of the present invention, is that tighter rolls achieved using the apparatus and methods of the present invention have more length and are less likely to jam in the machines in which the rolls are used.

Another advantage of the present invention is that this winding arbor can produce smaller rolls having diameters of only one inch and only a few inches in diameter while still maintaining a sufficient vacuum or pressure to perform starting and removal of the coreless, tuckless, rolls.

Yet another advantage of the present invention is that this winding arbor can be used to produce multiple rolls having narrow widths while still having the surface area on the tube of the arbor to provide the required vacuum or compressed air.

Still another advantage of the present invention is that this winding arbor can be used with paper stocks which are generally too porous to be able to draw an adequate vacuum.

Availability of the pertinent parts and components of the present system are as follows: rotary union 80 either Deublin Model 1300-082-014-⅝" - 18 UNF RH or Deublin Model 1102-07-029-RH; quick-disconnect Parker Quick Disconnect Fitting Nipple Part No. H2C (steel) and Parker Quick Disconnect Fitting Coupler Part No. 23E (steel); balls 0.0937 chrome steel from McMaster-Carr; compression spring formed from 0.007 diameter Music Wire from McMaster-Carr; 3-way valve ASCO-J 551-00-034 4-way 3 position detented lever operated valve for pressure/vacuum selection ¼" or Armite V 4404-3PD 4 way, 3 position detented lever operated ½"; vacuum pump Gast 1023-101Q-G608X Pump Unit ¾ HP 115 or 230 v. mounted on 30 gallon tank with vacuum switch, gauge and shutter valve.

Although the invention has been described with particular reference to certain preferred embodiments thereof, variations and modifications of the present invention can be effected within the spirit and scope of the following claims.

What is claimed is:

1. A surface winding slitting machine for producing coreless, tuckless paper rolls, said machine comprising:

a pair of bed rolls;

a rider roll;

a winding arbor having a tube portion and being positioned above said bed rolls and beneath said rider roll;

a plurality of two-way air valves positioned around and along the surface of the winding arbor, wherein each of said two-way air valves extends through the tube portion of said winding arbor and wherein each of said two-way air valves has an open position and a closed position to control the passage of air from the central cavity through each of said air valves;

a groove in said winding arbor for guiding a cutter for removing a pretucked tail;

a compressed air supply;

a vacuum supply;

an air valve having positions for regulating the supply of compressed air or vacuum to said winding arbor; and a connector for connecting said air valve and said winding arbor.

2. The machine of claim 1 wherein each of said plurality of two-way air valve assemblies includes a ball, a spring and a valve seat wherein the valve seat contains the ball and spring and the ball and the spring cooperate to provide an open valve or a closed valve.

3. The machine of claim 1 wherein said connector includes a quick disconnect to enable detachment from air supplies.

4. The machine of claim 1 wherein said plurality of two-way air valve assemblies are arranged in rows in the tube portion of said winding arbor.

5. The machine of claim 4 wherein said two-way air valve assemblies in each row are offset to provide additional surface area for said air valve assemblies.

6. The machine of claim 4 further including grooves on the surface of the tube portion of said winding arbor, wherein said grooves extend between said air valve assemblies.

7. A winding arbor for winding coreless paper rolls, said winding arbor having a plurality of air valve assemblies positioned around and along the surface of the winding arbor, each of said air valve assemblies extending from the surface of the winding arbor to a central cavity in said winding arbor and each of said air valve assemblies having an open position and a closed position to control the passage of air from the central cavity through each of said air valve assemblies.

8. The winding arbor of claim 7 wherein the plurality of air valve assemblies each include a ball, a spring and a valve seat containing the ball and the spring, wherein the spring biases the ball in a closed position and wherein pressure on the ball compresses the spring so the ball moves to an open position.

9. The winding arbor of claim 8 further including grooves on the surface of the tube portion of said winding arbor, wherein said grooves extend between said air valve assemblies.

10. A surface winding slitting machine for producing coreless, tuckless paper rolls, said machine comprising:

a pair of bed rolls;

a rider roll;

a cutter for providing a substantially straight edge;

a winding arbor having a tube portion and being positioned above said bed rolls and beneath said rider roll;

a plurality of two-way air valve assemblies positioned around and along the surface of the tube portion of said arbor, wherein each of said two-way air valves extends through the tube portion of said arbor and wherein each of said two-way air valves has an open position and a closed position to control the passage of air from the central cavity through each of said air valves;

a curved tucker blade adjacent said winding arbor;

a compressed air supply;

a vacuum supply;

an air valve having positions for regulating the supply of compressed air or vacuum to said winding arbor; and a connector for connecting said air valve and said winding arbor;

wherein said curved tucker blade guides a substantially straight cut edge cut by said cutter against said winding arbor.

11. The machine of claim 10 further including bearing surfaces on said curved tucker blade for contacting said winding arbor while said winding arbor is rotating.

12. The machine of claim 10 wherein each of said plurality of two-way air valve assemblies includes a ball, a spring and a valve seat.

13. The machine of claim 10 wherein said connector includes a quick disconnect to enable detachment from air supplies.

14. The machine of claim 10 wherein said plurality of two-way air valve assemblies are arranged in rows in the tube portion of said winding arbor.

15. The machine of claim 14 wherein said two-way air valve assemblies in each row are offset to provide additional surface area for said air valve assemblies.

16. The machine of claim 15 further including grooves on the surface of the tube portion of said winding arbor, wherein said grooves extend between said air valve assemblies.

17. A method of making tuckless, coreless paper rolls comprising the steps of:

providing a paper web having a pretucked tail;

removing said pretucked tail from said paper web;

pulling a vacuum through each of a plurality two-way air valves located on the tube wall of a winding arbor to hold said paper web to said winding arbor, wherein each of said plurality of two-way air valves has an open position and a closed position to control the passage of air from a central cavity through each of said air valves and wherein each of said two-way air valves opens as the winding of paper from the web covers each air valve respectively;

removing said vacuum after completing a first winding of paper web onto winding arbor;

winding a paper roll on said winding arbor; and applying compressed air through said two-way air valves for removing said paper roll from said winding arbor.

18. A method of making tuckless, coreless paper rolls comprising the steps of:

providing a paper web having a substantially straight edge;

using a curved guide blade to align the substantially straight edge of the paper web on the arbor;

pulling a vacuum through each of a plurality two-way air valves located on the tube wall of a winding arbor to hold said paper web to said winding arbor, wherein each of said plurality of two-way air valves has an open position and a closed position to control the passage of air from a central cavity through each of said air valves and wherein each of said two-way air valves opens as the winding of paper from the web covers each air valve respectively;

removing said vacuum after completing a first winding of paper web onto winding arbor;

winding a paper roll on said winding arbor; and applying compressed air through said two-way air valves for removing said paper roll from said winding arbor.

19. The method of claim 18 further including the step of backing up the winding machine so the substantially straight edge of the paper web is proximate to the curved guide blade.

* * * * *